US005299628A

United States Patent [19]

Ashok

[11] Patent Number: 5,299,628

[45] Date of Patent: Apr. 5, 1994

[54] METHOD AND APPARATUS FOR THE CASTING OF MOLTEN METAL

[75] Inventor: Sankaranarayanan Ashok, Bethany, Conn.

[73] Assignee: Olin Corporation, Va.

[21] Appl. No.: 725,867

[22] Filed: Jul. 3, 1991

[51] Int. Cl.[5] ..... B22D 11/06

[52] U.S. Cl. ..... 164/479; 164/429

[58] Field of Search ..... 164/423, 463, 429, 479

[56] References Cited

U.S. PATENT DOCUMENTS 4,789,022 12/1988 Ohno ..... 164/463

OTHER PUBLICATIONS

"Introduction to Ceramics" by W. D. Kingery, 1960, John Wiley & Sons, Inc. p. 490.

*Primary Examiner*—Kuang Y. Lin

*Attorney, Agent, or Firm*—Bruce E. Burdick

[57] ABSTRACT

A method and apparatus for the casting of metal onto a moving horizontal surface in which the solidification of the casting occurs from the top to the bottom. The surface on which the metal is cast comprises a material having a low thermal conductivity of 10 or less watts/-meter° Kelvin. If desired, the casting may be cooled by cooling the top of the casting at a point downstream of the feeding system.

7 Claims, 1 Drawing Sheet

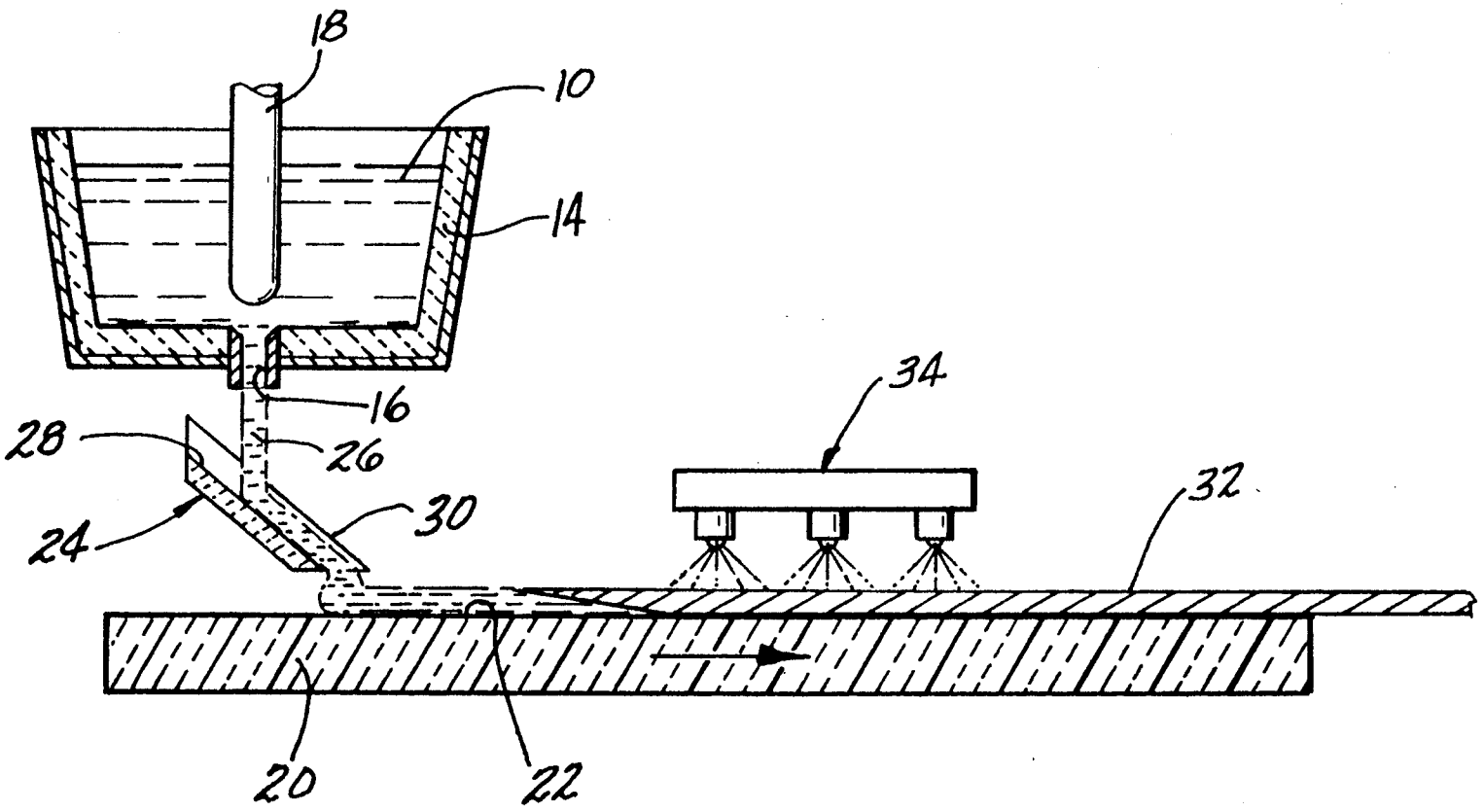
10
14
18
16
26
28
24
30
34
32
22
20

METHOD AND APPARATUS FOR THE CASTING OF MOLTEN METAL

BACKGROUND OF THE INVENTION

1. Field of the Invention

This invention relates generally to the casting of metal, and more particularly, this invention relates to the casting of molten metal onto a planar area of a continuous moving casting surface such as a continuous moving substrate.

2. Background Information

The metals industry has been developing a process and apparatus for producing an as-cast product that needs little or no additional processing such as hot rolling to reduce it to strip form. One such process that has arisen as a result of this development is the single belt casting process. In such a process molten metal is caused to flow onto a moving horizontal surface such as a continuous belt whereupon it solidifies as it moves horizontally along with the belt. The solid strip of metal is removed from the continuous belt for further processing as desired.

In conventional casting utilizing a horizontal moving mold such as a belt, cooling has typically been provided to the molten metal on the belt from the bottom side. That is, the cooling has been provided through the belt against the bottom side of the metal against the belt. In so doing, it has been noticed that with such type of cooling, porosity may occur in the middle of the cross-section of the strip. This is thought to be due to the fact that even though cooling is directed at the bottom side of the strip, the atmosphere serves to cool the top of the molten metal. Thus, there is directional solidification from both the top and the bottom of the strip of metal as it solidifies. This porosity in the middle of the cross-sectional area of the strip is undesirable in that it cannot be machined or easily removed. In addition, attempts to provide unidirectional cooling from the bottom by rapidly cooling the molten strip from underneath is complicated by the fact that air gaps form between the strip and the substrate which acts as an insulator.

U.S. Pat. No. 4,789,022 discloses a process for casting metal ribbon having unidirectional solidification. However, in that patent, it is required to preheat the substrate to a temperature above the melting point of the molten metal. Additionally, the process disclosed therein is directed to the casting of molten ribbon, not strip as contemplated by the present invention.

SUMMARY OF THE INVENTION

In view of the above, it is an object of the present invention to provide an improved method of casting onto a planar area of a continuously moving substrate to form a strip in which the metal strip undergoes solidification from the top side of the strip, which is the side of the strip opposite the substrate.

The above and other objects of the present invention may be achieved through the use of a substrate having a thermal conductivity sufficiently low to minimize extraction of heat and cooling from the bottom side of the strip so that at least 80% of the thickness of the strip is cooled from the top. This may be accomplished by the use of a substrate having a thermal conductivity of 10 or less watts/meter° Kelvin.

BRIEF DESCRIPTION OF THE DRAWINGS

The present invention will be better understood by reference to the following detailed description and to the accompanying drawing in which the FIGURE is a schematic elevational view, partly in section, of a casting apparatus for use in practicing the present invention.

The present invention is directed to the casting of strip from molten metal. By strip is meant metal having a rectangular cross-section of substantially greater width than thickness and in which the thickness is between about $\frac{1}{8}$ to about $\frac{3}{4}$ inch and preferably between about $\frac{1}{4}$ to $\frac{1}{2}$ inch. While the process and apparatus of the present invention may be applicable to many metals, it is particularly applicable to the casting of copper and copper alloys.

DETAILED DESCRIPTION

Referring to the drawing, there is shown schematically a casting system which incorporates the present invention. The molten metal 10 may be supplied to the casting apparatus 12 from a refractory lined vessel 14 having a discharge opening 16 therein. A plunger 18 is provided in the interior vessel 14 which is associated with the discharge opening to control the flow of molten metal from the vessel 14. For this purpose, the plunger 18 may be vertically reciprocated by any suitable mechanism (not shown).

A moving substrate 20 having a planar horizontally-disposed surface portion 22 is mounted beneath the discharge opening 16 of the vessel 14. Feeding means such as a refractory-lined tundish 24 is provided between the vessel 14 and the surface portion 22 in a position to receive the stream 26 of molten metal issuing from the outlet of the vessel 14. The tundish 24 may be in the form of a refractory lined trough-like member having a generally flat inclined bottom 28 with vertical side edges 30. The tundish 24 is inclined such that its flat or planar bottom surface 28 is inclined downwardly toward the downstream side of the moving substrate 20 such that its discharge end is pointing toward the downstream end. With the arrangement shown, the molten metal stream 26 flows downwardly from the outlet orifice 16 and impacts against the bottom surface 28 of the tundish 24 and then flows down the inclined bottom surface 28 thereof onto the surface portion 22 of the moving substrate 20 and solidifies into a strip 32.

In accordance with the present invention, the substrate 20 is fabricated from a material having low thermal conductivity so that unidirectional solidification occurs from the top surface downward. The thermal conductivity of the substrate should be low enough that cooling from the bottom side of the strip positioned against the substrate is minimized so that at least 80% of the thickness of the strip is cooled from the top surface down. In this regard, the substrate should be fabricated from a material having a thermal coefficient equal to or less than 10 watts/meter° Kelvin. Examples of such materials include high temperature glasses, such as quartz, and porous ceramics, such as PYROTEK, made by Pyrotek, Inc. of Carlisle, Pa. By using such a material having a low thermal coefficient, the extraction of heat through the substrate is minimized and cooling is substantially accomplished from the top to bottom.

If desired, the top surface of the casting may be cooled by means of water jets 34 or the like positioned above the substrate and strip and positioned downstream of the feeding means. Additionally, should it be necessary, the substrate 20 may be preheated upstream of the feeding means 24 to remove moisture and organic materials which could cause gas bubbles during the casting operation. However, the preheating should be to a temperature substantially less than the melting point of the molten metal being cast.

The substrate may be in the form of an endless belt such as a caterpillar drive in which the substrate is in the form of blocks mounted on an endless chain for movement about spaced rollers. The molten metal is supplied to the upper run of the drive. The molten metal is carried forward by the substrate 20 to a point where it is solidified into a continuous strip. The strip is then separated from the belt and may be either directly coiled or removed on a roller system for further processing.

While the invention has been described above with reference to specified embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A process for the casting of metal strip comprising:
providing a source of molten metal;
providing a moving unheated substrate for receiving said molten metal thereon and upon which said metal solidifies as it moves away from said source, said substrate being selected from a material having a thermal coefficient sufficiently low that at least 80% of the solidification occurs progressively in a downward direction starting from the top of the strip.

2. The process of claim 1 further comprising cooling the top surface of said cast metal at a point downstream of said source.

3. A process for the casting of metal strip comprising:
providing a source of molten metal;
providing a moving substrate for receiving said molten metal thereon and upon which said metal solidifies as it moves away from said source, said substrate being selected from a material having a low thermal coefficient to minimize cooling from the bottom surface of the metal positioned against said substrate so that at least 80% of the thickness of the metal strip is cooled from the top.

4. An apparatus for the casting of metal strip comprising:
a source of molten metal;
a moving unheated substrate for receiving the molten metal thereon; and
means for depositing the molten metal on the substrate and moving said deposited molten metal away from said source to cause the solidification thereof, said substrate having a thermal coefficient of 10 or less watts/meter° Kelvin so that at least 80% of the strip is progressively solidified in a downward direction.

5. The apparatus of claim 4 further including cooling means for cooling said cast metal on said substrate, said cooling means being positioned over the top of said substrate and downstream of said source of molten metal.

6. The apparatus of claim 4 further including means for preheating said substrate to a temperature below the melting point of said molten metal being cast to remove moisture of the system.

7. An apparatus for the casting of metal strip comprising:
a source of molten metal;
a moving unheated substrate for receiving the molten metal thereon; and
means for depositing the molten metal on the substrate and for moving said molten metal away from said source to cause the solidification thereof, said substrate having a low thermal coefficient to minimize cooling from the bottom surface of the metal positioned against said substrate so that at least 80% of the thickness of the metal strip is cooled from the top.

* * * * *